United States Patent [19]

Duthion et al.

[11] 4,166,477

[45] Sep. 4, 1979

[54] DISCHARGE CONDUITS OF STEAM GENERATORS AND THE LIKE

[75] Inventors: Louis Duthion; Max Sagner, both of Paris; Claude Portier, Le Chesnay, all of France

[73] Assignees: Bertin & Cie, Plaisir; Stein Industrie, Velizy-Villacoublay, both of France

[21] Appl. No.: 699,871

[22] Filed: Jun. 25, 1976

[30] Foreign Application Priority Data

Jun. 26, 1975 [FR] France ..... 75 20074

[51] Int. Cl.[2] ..... F17D 1/02

[52] U.S. Cl. ..... 137/604; 98/58; 126/307 R; 126/312; 137/561 R; 137/801

[58] Field of Search ..... 137/314, 511, 604, 801, 137/561 R; 138/40, 39; 251/155; 122/507; 98/59, 60, 307, 58, 46, 48; 239/601; 126/307 R, 312

[56] References Cited

U.S. PATENT DOCUMENTS

| | | | |
|---|---|---|---|
| 201,484 | 3/1878 | Bash | 126/307 R |
| 222,207 | 12/1879 | Simmons | 126/312 |
| 287,258 | 10/1883 | Egnor | 126/307 R |
| 1,412,865 | 4/1922 | Harter | 137/314 |

*Primary Examiner*—Irwin C. Cohen
*Attorney, Agent, or Firm*—A. W. Breiner

[57] ABSTRACT

The invention provides, at the end of a pipe which extends a valve being part of an exhausting device for pressure-relieving a pressurized fluid, a nozzle which is exactly at the input of a hood, the convergent portion of said nozzle reducing its exit section so as to make it substantially double the maximum passageway section through the valve.

3 Claims, 4 Drawing Figures

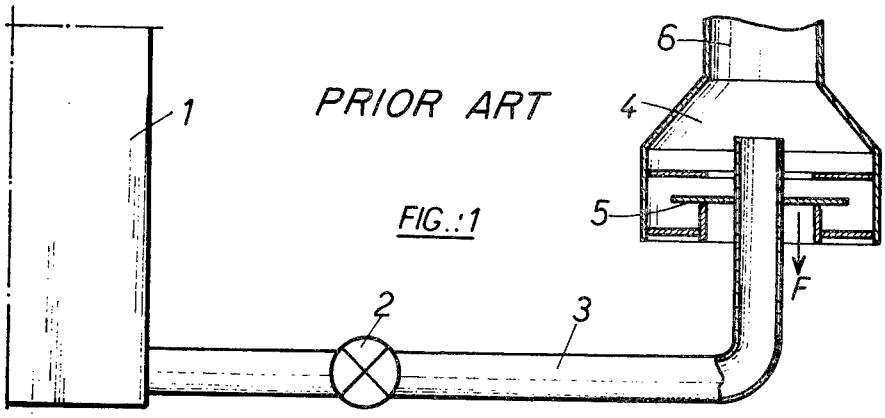
PRIOR ART
FIG.:1
1
2
3
4
5
6
F
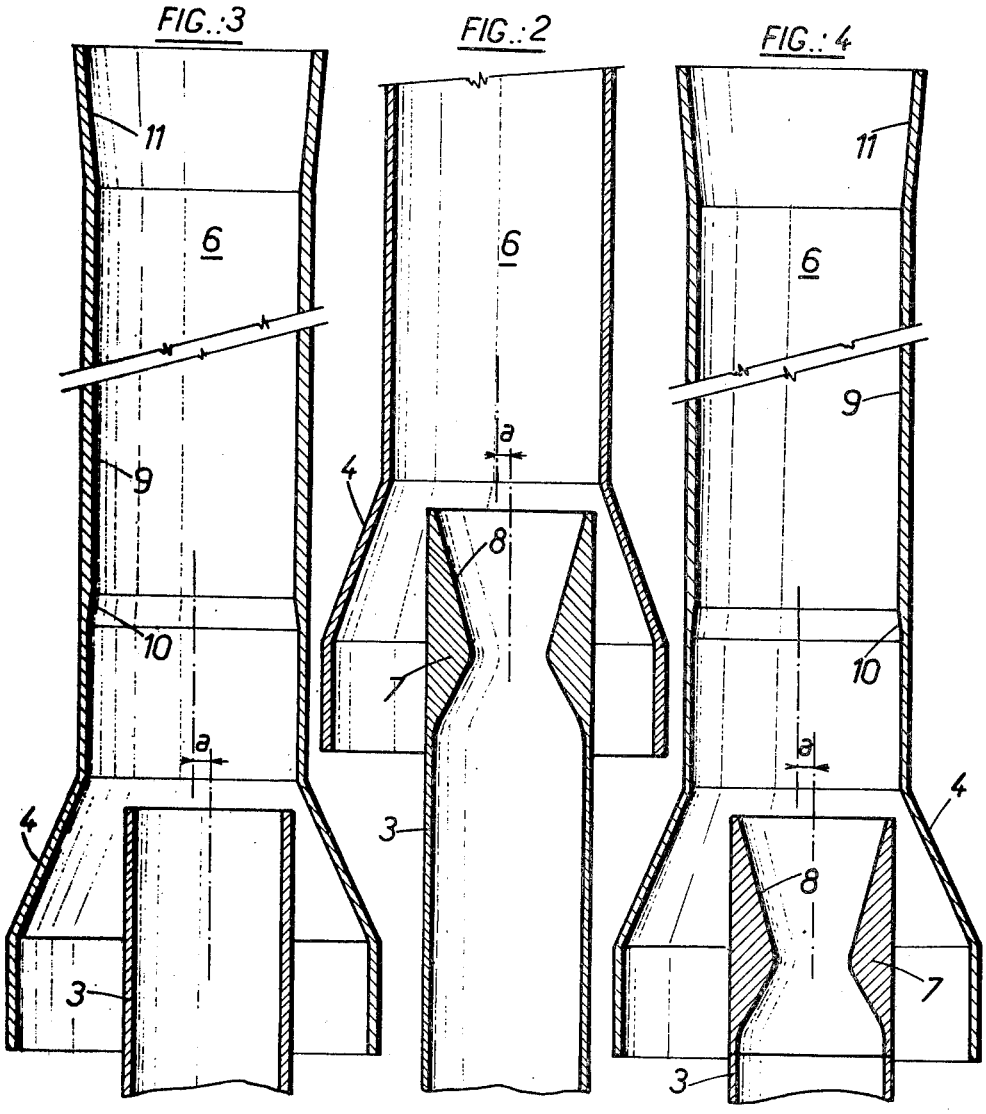
FIG.:3
FIG.:2
FIG.:4
3
4
6
7
8
9
10
11
a

DISCHARGE CONDUITS OF STEAM GENERATORS AND THE LIKE

Steam boilers must be equipped with a certain number of safety valves that open automatically in the event of an overpressure and the outputs of which are fixed by statutory provisions. Automatically controlled discharge valves are also used to ensure an adequate discharge of steam in certain types of plant in order to prevent them from being destroyed through excessive overheating of the metal under certain operating conditions.

The steam escaping through a valve is usually discharged into the open air through a low-pressure chimney, the connection between the valve proper and the chimney being provided by a venting device called a "hood".

FIG. 1 in the accompanying drawings, which diagrammatically illustrates a prior art arrangement, shows a boiler 1 to which is rigidly fixed a discharge valve 2 extended by an exhaust conduit 3 leading up to a hood 4 which is equipped at its inlet with a floating plate 5 serving as a free valve and which is followed by a conduit 6 of larger diameter in order to permit free expansion of the various components, the conduit 6 being rigidly connected to a chimney (not shown) or to a structure of the building housing the plant.

Experience shows that in cases where a very rapid discharge is necessary, that is to say a large and sudden opening of valve 2, an arrangement of the above kind can result in a backflow F of steam at the entrance to hood 4. Such backflow can in fact occur in any case if the pressure loss produced by the hood's discharge conduit 6 is too great, for instance because it embodies several elbows.

For the valve 2 to be effective, it must be the component that effectively controls the discharge flow rate, and it is for this reason that, in the prior art arrangements presenting the above drawback, this valve 2 is extended in the direction of hood 4 by a pipe having a cross-section much greater than the maximum passageway section of the valve; for example, the section of said pipe may be ten times greater than the valve passageway section.

Nonetheless, the inrush of steam into hood 4 and conduit 6 creates a "bottleneck" therein, which causes a backflow of steam, which in turn produces high stresses and, above all, jets of steam through the clearances around floating plate 5.

The object of this invention is to avoid such steam backflows without introducing modifications of the kind requiring rebuilding of existing plant. On the contrary, one of the most notable advantages of the improvement according to this invention is that of providing an accessory adaptable to existing installations, which can be retained virtually as they are.

This is achieved through a better utilization of the expansion energy available in the steam.

For it has been found that the valve performs the required flow rate adjustment correctly provided that it is subjected to sonic flow conditions, that is to say provided that expansion of the steam through such valve takes place with a pressure ratio greater than two to one. It is to be noted in this connection that, in the prior art arrangement, the expansion ratio is substantially equal to the useful pressure value in the boiler, that is, 120 for example in a modern type of boiler.

It will thus be appreciated that the conventional arrangement wastes a very great part of the energy contained in the steam, and it is of this energy that the invention proposes to take advantage for improved operation and especially for improving the exhausting of steam outside buildings.

The invention accordingly provides, at the end of the pipe which extends the valve and exactly at the input to the hood, a nozzle the convergent portion of which so reduces its exit section as to make it substantially double the maximum passageway section through the valve. As a result, the jet issuing from this convergent nozzle portion is possessed of considerable velocity-induced energy which ensures proper functioning of the hood even in cases where the latter is extended by a discharge conduit of mediocre characteristics.

The nozzle can be still further improved by imparting to it a convergent-divergent shape calculated on the basis of the average steam exit conditions, by so applying the laws of aerodynamics as to cause such convergent-divergent nozzle to ensure correct expansion of the steam under supersonic flow conditions, thereby further improving the recovery of energy by comparison with a straightforward convergent nozzle.

Yet another improvement, which may or may not be associated to the aforesaid improvement, consists in narrowing the hood inlet opposite the nozzle by means of a convergent section followed by a cylindrical mixer and then a divergent section, thus enabling the flow issuing from the nozzle to be picked up under optimum conditions.

The improvement in operation afforded by a narrowed portion according to the invention, proximate the break in continuity in the discharge conduit, is indeed such that the floating plate 5 and even the hood 4 could be dispensed with, it being possible for the break in continuity between conduits 3 and 6 to be an open air gap. However, it is usually preferable not to dispense with conduits 3 and 6 because operating noise could become excessive; moreover, such a hood is a simple and robust means of permitting relative transverse shifts in the upstream and downstream parts of the discharge conduit.

The description which follows with reference to the accompanying non-limitative exemplary drawings will give a clear understanding of how the invention can be carried into practice.

In the drawings:

FIG. 1 is a diagrammatic illustration of a conventional arrangement of the kind referred to in the preamble; and FIGS. 2, 3 and 4 are schematic views in partial longitudinal section of three possible forms of embodiment of the invention, FIG. 4 being the preferred embodiment.

In accordance with this invention, the embodiment in FIG. 2 shows, at the end of discharge conduit 3, a nozzle 7 which may be merely of convergent configuration but is preferably convergent-divergent as shown in the drawing.

If a purely convergent nozzle is adopted, its exit section will be about twice the maximum passageway section through the discharge valve. There accordingly remains a significant pressure loss at valve level, which may be 60 bars for example if the pressure in the boiler is 120 bars, and yet the steam jet issuing from nozzle 7 reaches the speed of sound. It consequently possesses considerable energy which, in many cases, is sufficient to improve operation of the hood 4 and ensure proper functioning of exhaust conduit 6.

On the other hand, if preference is given to the improvement that is applicable in more difficult cases, the nozzle 7 comprises a divergent 8 matched to the level to which the steam expands between discharge conduit 3 and the atmosphere, 60 bars for example. Under such conditions, the steam jet issuing from nozzle 7 will have reached supersonic speed through the divergent 8. All its energy will thus be converted into kinetic energy and its discharging power into exhaust conduit 6 is thus improved.

The alternative embodiment in FIG. 3 provides a more costly but more effective solution from the energy recovery point of view. It consists in equipping the initial portion of exhaust conduit 6 with a cylindrical section 9 of smaller diameter enabling a supersonic flow of lower Mach number to be established that can consequently be initiated with a higher downstream backpressure. This narrower section 9 may be preceded by a shallow-angle convergent section 10 and followed by a corresponding divergent section 11.

This latter-mentioned arrangement makes it possible in difficult cases to use a much smaller and much more tortuous exhaust conduit 6 than the customary conduits.

The most efficient form of embodiment, shown in FIG. 4, includes both the nozzle 7 mounted on the end of discharge conduit 3 and the narrowed cylindrical section 9 preceded by convergent 10 and followed by convergent 11 which is positioned immediately past the hood 4, at the origin of exhaust conduit 6.

It goes without saying that the scope of the present invention is by no means limited to pressure relieving on steam generators but extends also to the total or partial emptying of tanks of any kind containing a gas at high pressure.

For proper application of the invention it is necessary that the nozzle and the hood be substantially concentric during the discharge process, that is to say when conduit 3 is hot. In order to make allowance for expansion of this conduit or for any other deformation thereof, for example responsively to the expansion pressure of the steam, these elements are offset when cold, as shown in FIGS. 2, 3 and 4, by a value a chosen equal to the deformation sustained in service.

We claim:

1. An exhausting device for pressure-relieving a high-pressure apparatus comprising in combination an exhaust conduit comprising a tubular downstream portion and a generally cylindrical shaped upstream portion which is of smaller diameter than said tubular downstream portion, said conduit having a widened inner end in the form of a hood open to ambient, said generally cylindrical upstream portion being preceded by a convergent section connected to said hood, and being followed by a divergent section defining said tubular downstream position, a valve controlled discharge pipe having means for connecting said pipe to a high-pressure apparatus at one end with the other end positioned within said hood, a jet nozzle having a convergent-divergent configuration integral with said discharge pipe and forming a constricting outlet end for said pipe which projects into said hood while being inwardly spaced from the wall thereof, the convergent section of said jet nozzle being connected to said pipe and the divergent section opening into said exhaust conduit.

2. Device as claimed in claim 1, wherein the minimum cross-sectional flow area of said nozzle is substantially equal to twice the maximum passage area of the valve controlling said discharge pipe.

3. Device as claimed in claim 1, wherein said jet nozzle and said hood extending around the same are non-coaxial when cold, the axis of said nozzle being shifted sideways with respect to the axis of said hood.

* * * * *